US005950515A

United States Patent [19]

Wetzel

[11] Patent Number: 5,950,515

[45] Date of Patent: Sep. 14, 1999

[54] APPARATUS FOR SLICING VEGETABLES

[76] Inventor: Clifford C. Wetzel, 2575 W. Washington Rd., Ithaca, Mich. 48847

[21] Appl. No.: 08/954,328

[22] Filed: Oct. 17, 1997

[51] Int. Cl.[6] ..... B26D 7/06; B26D 1/03

[52] U.S. Cl. ..... 83/403.1; 83/425.1; 83/425.3; 83/436.1; 83/436.6; 83/858; 83/932

[58] Field of Search ..... 83/26, 932, 952, 83/403.1, 436.1, 424, 425.1, 425.2, 425.3, 429, 435, 435.2, 436.6, 856, 858; 99/538

[56] References Cited

U.S. PATENT DOCUMENTS

| | | | |
|---|---|---|---|
| 709,811 | 9/1902 | Baker, Jr. et al. | 83/425.2 X |
| 1,878,423 | 9/1932 | Nowlin | 83/435.2 X |
| 2,705,986 | 4/1955 | Wetzel . | |
| 2,722,256 | 11/1955 | Hise | 83/424 |
| 2,785,715 | 3/1957 | Brundell et al. | 83/436.1 X |
| 3,490,504 | 1/1970 | Reynolds | 83/435 |
| 4,062,260 | 12/1977 | Steinhogl | 83/425.3 X |
| 5,211,098 | 5/1993 | Mendenhall | 83/932 X |
| 5,224,409 | 7/1993 | Cimperman et al. | 83/932 X |
| 5,343,791 | 9/1994 | Julian et al. | 83/932 X |
| 5,394,780 | 3/1995 | Foster et al. | 83/932 X |
| 5,568,755 | 10/1996 | Mendenhall | 83/932 X |

*Primary Examiner*—Rinaldi I. Rada
*Assistant Examiner*—Charles Goodman
*Attorney, Agent, or Firm*—Reising, Ethington, Barnes, Kisselle, Learman & McCulloch, P.C.

[57] ABSTRACT

A method and apparatus for cutting a vegetable, such as a potato, into pieces suitable for the preparation of cottage-fried, french-fried, and shoestring potatoes, has a plurality of vertically arranged propelling units, each of which has a plurality of wheels having their peripheries adjacent but spaced from one another so as to define a path along which such vegetable may travel through successive propelling units and be accelerated to a speed at which it will pass through a cutter having blades which cut the vegetable into pieces.

18 Claims, 2 Drawing Sheets

APPARATUS FOR SLICING VEGETABLES

This invention relates to a method and apparatus for slicing a raw vegetable, such as a potato, into a plurality of pieces suitable for making cottage-fried, french-fried, or shoestring potatoes.

BACKGROUND OF THE INVENTION

In preparing raw potatoes for the production of cottage-fried, shoestring, french-fried, steak fried, and other cut forms of potatoes, it is conventional to cut a washed, peeled, or unpeeled raw potato by means of a water knife which cuts the potato satisfactorily, but consumes enormous quantities of water. The amount of water thus utilized presents problems not only in delivering the water to the site of the cutting operation, but also requires considerable equipment for cleaning the water and disposing of both the water and the materials extracted during the cleaning process.

The water knife cutting process does not lend itself to the cutting of vegetables other than potatoes because saturating other vegetables with water may adversely affect their appearance and use in the manner intended.

An object of the invention is to provide vegetable slicing apparatus which overcomes the disadvantages referred to above.

SUMMARY OF THE INVENTION

Vegetable slicing apparatus constructed and operated in accordance with the invention comprises a plurality of spaced vegetable engaging and propelling units, each of which successively engages and propels a vegetable along a path leading to cutting apparatus located in such path. Each propelling unit preferably is the same and comprises a plurality of uniform diameter wheels whose peripheries engage the vegetable. The wheels of each propelling unit are driven in such direction that their adjacent peripheries define the path of travel of the vegetable and all of the wheels of each unit are driven in such direction that their peripheries engage and move the vegetable in a single direction along such path. The peripheral speed of all of the wheels of each propelling unit is the same. However, the peripheral speed of the vegetable engaging wheels of each successive propelling unit is greater than that of the immediately proceeding unit so that, as each vegetable is propelled along the path, its speed of movement is accelerated. The speed at which the vegetable is discharged from the final downstream propelling unit is sufficient to enable the vegetable to pass through the cutting apparatus and be cut into a plurality of strips or slices.

The cutting apparatus preferably comprises first and second sets of transversely spaced knives, the knives of the first set being parallel to one another and the knives of the second set also being parallel to one another, but offset 90° from the knives of the first set. As a consequence, a vegetable passing through the cutting apparatus is cut into a plurality of substantially rectangular, elongate strips suitable for the preparation of french-fried or shoestring potatoes.

THE DRAWINGS

Apparatus constructed in accordance with the invention is illustrated in the accompanying drawings wherein.

DETAILED DESCRIPTION

Figure 1:
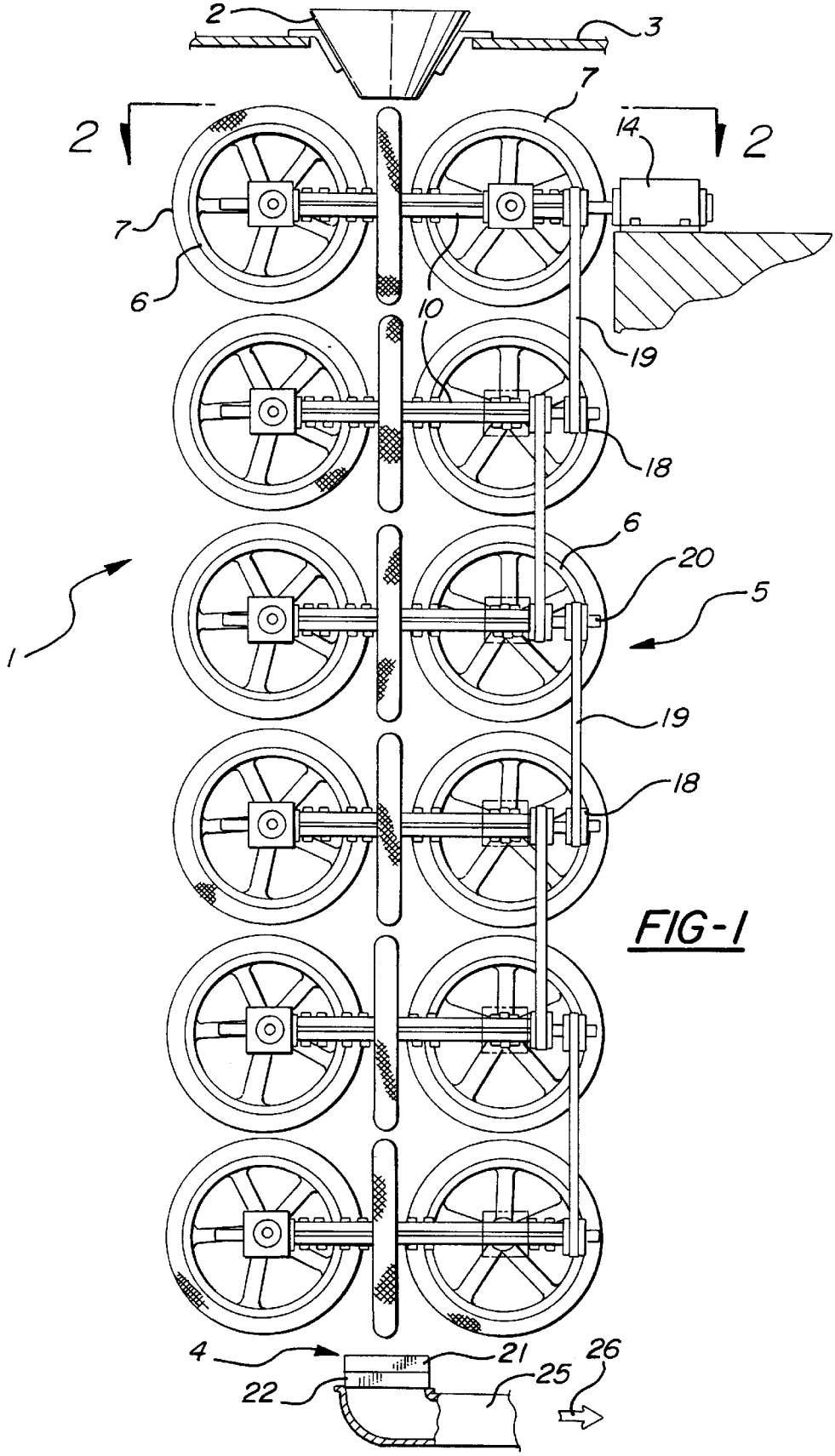
FIG. 1 is a vertical elevational view, partly in section, of the apparatus.

The slicing apparatus is designated generally by the reference character 1 and comprises a vegetable delivery chute 2 supported on a suitable frame 3, cutting apparatus 4 spaced from and directly below the chute 2, and a plurality of vertically spaced vegetable propelling units 5, each of which preferably is the same.

Each propelling unit 5 comprises a plurality, preferably four, of wheels 6, each of which has a pneumatic tire 7 at its periphery. As used herein, the term "wheel" includes the wheel 6 and its tire 7, unless the context clearly is otherwise. Each tire preferably is formed of rubber or equivalent resilient material so as to have a highly frictional surface. Each tire is inflated, but to a relatively low internal pressure, such as 3–5 psi. Each tire, therefore, is form stable, but is yieldable for a purpose presently to be explained.

In the disclosed embodiment there are four identical wheels 6 constituting each propelling unit 5. Each of the wheels 6 has hub 8 beyond both ends of which extends a stub shaft 9. The stub shaft of one of the wheels is connected by a tubular coupling 10 to one output shaft 11 (FIG. 2) of a 90° drive transmission gear box 12 of the kind manufactured by Hub City Manufacturing Company, of North Dakota. The input shaft (not shown) of the gear box 12 is connected by a similar coupling 10 to the drive shaft 13 of a variable speed electric motor 14. A second output shaft of the gear box 12 is coupled via a coupling 10 to the stub shaft of a second wheel 6 and by another coupling 10 to a second 90° gear box 12*a*. The gear box 12*a* is coupled via a coupling 10 to a third wheel 6. The third wheel is connected by a coupling 10 to another gear box 12*b* which, in turn, is connected by a coupling 10 to one end of the stub shaft 9 of a fourth wheel 6. The arrangement is such that rotation of the output shaft 11 of the motor 14 causes conjoint rotation of all four wheels 6, and the construction of the gear boxes 12 is such that all four of the wheels rotate simultaneously and at the same peripheral speed.

Figure 2:
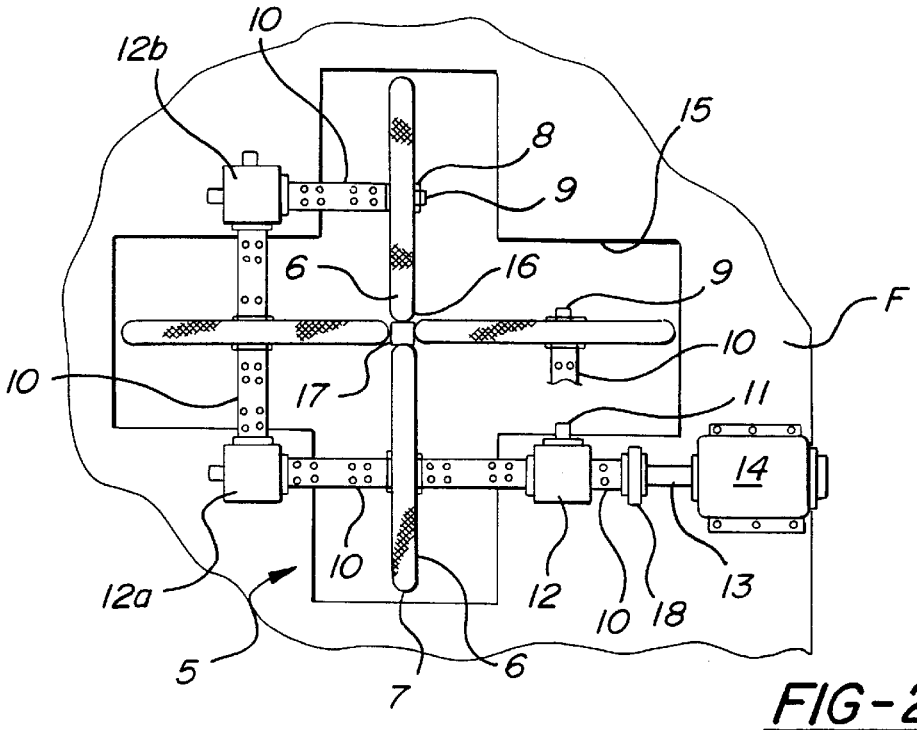
FIG. 2 is a top plan view taken on the line 2—2 of FIG. 1.
Figure 3:
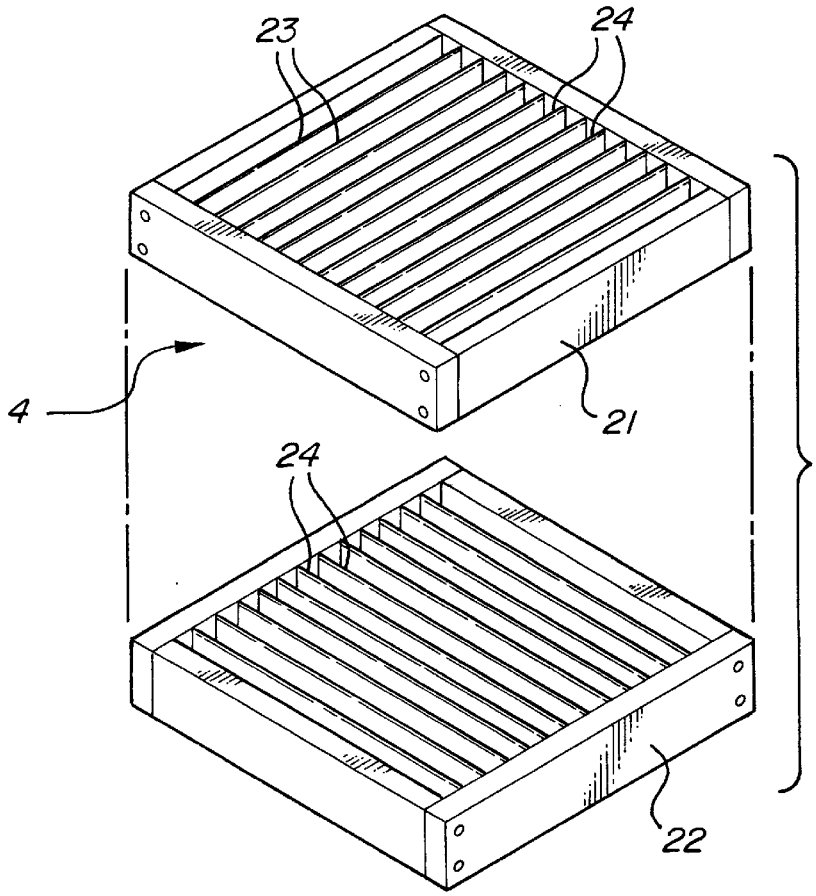
FIG. 3 is an exploded, greatly enlarged view of the vegetable cutting apparatus.

As is shown in FIG. 2, the gear boxes 12 and the motor 14 are supported on a frame F having an opening 15 therein for the accommodation of the units 5. The four wheels 6 of each unit 5 are so arranged that their axes of rotation are spaced 90° from one another. The peripheries of all four wheels confront, but do not engage each other. There thus is defined between the adjacent peripheries of all four wheels a space which constitutes a path 16 through which a vegetable 17 (FIG. 2) may pass. The low pressure and resilience of the tires 7 enable the vegetable 17 yieldably to be gripped, and the frictional surface of the tires will enable the vegetable to be accelerated in a vertically downward direction at a speed corresponding substantially to the peripheral speed of the tires of the wheels.

Each of the propulsion units corresponds to that just described with the exception that no separate driving motor is required for the additional units 5. Instead, the output shaft 13 of the motor 14 is drivingly coupled by pulleys 18 and a drive transmission belt 19 to a shaft 20 which parallels the motor shaft 13 and extends from corresponding wheels 6. Similar pulleys and belts drivingly couple the shaft 20 to corresponding shafts of the downstream units 5.

Although all of the gear boxes 12 are alike in construction, the gearing of each succeeding unit 5 is so selected that the peripheral speed of the wheels of each successive unit 5 is greater than that of the immediately upper unit 5. For example, if the peripheral speed of each wheel 6 of the uppermost unit 5 is 1000 feet per minute, the peripheral speed of the wheels of each successively lower unit may be increased by 1000 feet per minute, for example, so that the wheels of the lowermost unit 5 have a peripheral speed of 6000 feet per minute. Thus, as a vegetable traverses the path 16 leading to the cutting apparatus 4, it attains a vertically downward speed of approximately 6000 feet per minute.

As shown in the drawings, the driving motor 14 is coupled to the uppermost set of wheels which are driven at the slowest rate of speed. If desired, the motor can be coupled directly to the lowermost propulsion unit 5 instead of to the uppermost unit. This change in coupling may result in a more efficient drive arrangement.

The cutting apparatus 4 comprises a rectangular upper frame 21 and a similar, lower frame 22. The frames are secured together by suitable bolts or clamps (not shown). Each frame is open but is spanned by a plurality of uniformly spaced apart, parallel blades 23 having cutting edges 24 uppermost. The blades carried by the upper frame 21 and the blades carried by the frame 22 correspond in number and spacing, but the two sets of blades are arranged at 90° with respect to one another. Consequently, any vegetable traversing both sets of blades will be cut into a plurality of elongate, quadrangular strips.

Cut pieces of the vegetable are discharged into a receiver 25 which may be curved in a direction to enable the pieces to be delivered to a container represented by the arrow 26.

In the operation of the apparatus a vegetable, such as a potato suitable for producing strips to be made into french-fried or shoestring potatoes, is introduced to the feed chute 2 so that it falls by gravity with its longer axis substantially vertical. As the potato enters the space between the adjacent peripheries of the wheels of the uppermost propelling unit 5, the potato yieldably will be gripped by the four tires and accelerated downwardly along the path 16. Once the potato has cleared the upper propelling unit 5, it will be presented to the adjacent unit 5 where it again will be gripped by the peripheries of the four wheels and accelerated to the peripheral speed of the wheels of such adjacent unit 5. This procedure will be repeated at each successive propelling unit until finally the potato emerges from the lowermost propelling unit with sufficient speed to pass completely through the cutting apparatus 4 which will cut the potato into strips capable of producing french-fried or shoestring potatoes. The strips will pass through the receiver 25 to the container 26 for further processing.

If one set of blades is omitted, the potato presented to the cutter will be cut into parallel slices for the production of cottage-fried or similar potatoes.

Although each propelling unit 5 has been disclosed as having four wheels, it is possible to use a different number of such wheels. The greater the number of wheels, the more confined is the path along which the potato travels. However, the provision of more than four wheels produces some complications in driving all the wheels from a single motor.

It is important that all of the wheels of each propelling unit have substantially the same peripheral speed so as to avoid subjecting the vegetables to tearing or other forces that would be created by unequal peripheral speeds of one or more of the wheels of a single set of wheels. The easiest way of ensuring peripheral speed uniformity is to utilize wheels of the same diameter and drive each of them at the same speed.

A particularly desirable characteristic of the apparatus is that the potato is discharged from the lowermost propelling unit at a speed that is sufficient to enable the potato to pass completely through the cutting apparatus 4 without delay so as to avoid forming a barrier of cut pieces to oncoming potatoes. A linear speed of approximately 6000 feet per minute is adequate to accomplish this objective for both peeled and unpeeled potatoes.

The disclosed embodiment is representative of a presently preferred form of the invention, but is intended to be illustrative rather than definitive thereof. The invention is defined in the claims.

I claim:

1. Vegetable cutting apparatus comprising cutting means; a plurality of propelling units upstream from said cutting means for successively engaging and propelling a vegetable along a path toward and beyond said cutting means; and means for driving each of said propelling units at a selected rate of speed, the rate of speed of each successive one of said propelling units being greater than the rate of speed of each preceding one of said propelling units, whereby movement of the vegetable along said path is accelerated in successive stages to a predetermined speed.

2. The apparatus according to claim 1 wherein said path is substantially vertical and said successive propelling units are vertically spaced from one another.

3. The apparatus according to claim 1 wherein each of said propelling units comprises a plurality of rotatable members, each of said rotatable members having a periphery engagable with a vegetable occupying said path.

4. The apparatus according to claim 3 wherein the periphery of each of said rotatable members is yieldable.

5. The apparatus according to claim 3 wherein each of said rotatable members comprises a wheel mounting a yieldable tire.

6. The apparatus according to claim 1 wherein each of said propelling units comprises a set of wheels, each of said wheels having a periphery confronting but spaced from the periphery of the others of said wheels a distance to define said path.

7. The apparatus according to claim 6 wherein all of the wheels of each set of wheels rotate at a uniform speed.

8. The apparatus according to claim 6 wherein each wheel of each propelling unit is secured to a separate shaft, and wherein said drive means includes means coupling all the shafts of the wheels of each set of wheels to one another.

9. The apparatus according to claim 6 wherein all of the wheels of each set of wheels are of uniform diameter.

10. The apparatus according to claim 6 wherein all of the wheels of all sets of wheels are of uniform diameter.

11. The apparatus according to claim 1 wherein there are six of said propelling units.

12. The apparatus according to claim 11 wherein all six of said propelling units are substantially the same.

13. The apparatus according to claim 1 wherein said cutting means comprises a plurality of blades spaced from and parallel to one another.

14. Vegetable cutting apparatus comprising cutting means; a plurality of propelling units in vertically stacked relation above said cutting means for successively engaging and propelling a vegetable along a path leading to said cutting means, each of said propelling units comprising a plurality of wheels, each of each wheel of each of said units having a periphery and being rotatable about an axis, the periphery of each of the wheels of each unit confronting the periphery of each of the remaining wheels of such unit but spaced therefrom to define a portion of said path; means for rotating all of the wheels of the uppermost unit at a substantially uniform peripheral speed and in such direction as to cause all of the wheels of such unit to propel a vegetable engaged by the peripheries of the wheels of such unit along said path in a direction toward said cutting means; and means for driving all of the wheels of each successively lower one of said units in the same direction as the wheels of the uppermost unit but at a peripheral speed greater than that of the next higher adjacent unit, thereby accelerating the speed of the vegetable traversing said path, the peripheral speed of the wheels of the lowermost unit accelerating the movement of a vegetable moving along said path to a speed sufficient to enable such vegetable to pass through said cutting means and be cut into a plurality of pieces.

15. The apparatus according to claim 14 wherein each of said units has four of said wheels.

16. The apparatus according to claim 13 where all of said wheels are uniform in diameter.

17. The apparatus according to claim 14 wherein said cutting means comprises at least two sets of blades, the blades of one of said sets being spaced from and parallel to one another, and the blades of the second set being spaced from and parallel to one another, but substantially normal to the blades of said one of said sets.

18. The apparatus according to claim 14 wherein said cutting means comprises a plurality of blades spaced from and parallel to one another.

* * * * *